United States Patent [19]

Raasch

[11] 4,418,525

[45] Dec. 6, 1983

[54] DOUBLE-SIDED OPEN END SPINNING MACHINE

[75] Inventor: Hans Raasch, Monchen-Gladbach, Fed. Rep. of Germany

[73] Assignee: W. Schlafhorst & Co., Monchen-Gladbach, Fed. Rep. of Germany

[21] Appl. No.: 361,573

[22] Filed: Mar. 24, 1982

[30] Foreign Application Priority Data

Mar. 25, 1981 [DE] Fed. Rep. of Germany ..... 3111627

[51] Int. Cl.[3] ..... D01H 13/22; D01H 13/14; D01H 13/26

[52] U.S. Cl. ..... 57/264; 57/268

[58] Field of Search ..... 57/261, 263, 264, 265, 57/268, 270, 271

[56] References Cited

U.S. PATENT DOCUMENTS

| | | | |
|---|---|---|---|
| 3,360,914 | 1/1968 | Black et al. | 57/264 X |
| 4,028,869 | 6/1977 | Schafer et al. | 57/264 |
| 4,138,839 | 2/1979 | Stahlecker et al. | 57/263 X |
| 4,275,554 | 6/1981 | Tarbon et al. | 57/263 |

*Primary Examiner*—Donald Watkins

*Attorney, Agent, or Firm*—Herbert L. Lerner; Laurence A. Greenberg

[57] ABSTRACT

Double-sided open end spinning machine, including at least one closed travel track, a servicing device for traveling along the machine and a thread testing device for traveling along the machine, at least the servicing device being disposed on the at least one closed travel track, the servicing device including a travel direction reversing device and a travel obstacle indicator for each travel direction, the travel obstacle indicator being connected to the travel direction reversing device for reversing travel direction of the servicing device.

10 Claims, 5 Drawing Figures

DOUBLE-SIDED OPEN END SPINNING MACHINE

The invention relates to a double-sided open end spinning machine with a servicing device which can travel alongside of the machine, and a thread testing device which can likewise travel along the machine.

It is known in the art to have a servicing device travel along an open end spinning machine, which has the purpose of carrying out one of the following tasks automatically: ascertaining whether or not a thread break has occured, cleaning a spinning station, shutting down the spinning station prior to cleaning and restarting after cleaning, re-tying or re-starting the spinning of a broken thread and starting the spinning station up again after the thread break is corrected.

It is also known to continuously monitor thin and thick portions of the thread at each individual spinning station and to shut down the respective spinning station in the event of a thin or thick portion which can no longer be tolerated. Subsequently the spinning station can be re-started either by hand or automatically, and if required, after a preceding cleaning.

However, there are thread defects which cannot be ascertained by ordinary thin-or-thick-portion scanning or by a yarn cleaner. These are periodic yarn defects in which very small changes such as enlargement or weakening of the running yarn occur periodically. The characteristic feature of these yarn defects is not the extent of the enlargement which can often only be ascertained with difficulty, or weakening of the thread, but the fact that the defect recurs periodically. In addition, those spinning stations must be found which produce a yarn that has defects which follow each other relatively quickly, independently of the type of defect.

Even if only one spinning station of an open end spinning machine produces such faulty yarn without being detected, the entire thread output of the spinning machine can become rejects if a woven fabric is to be produced therefrom.

Therefore, great efforts must be made to find even very small periodic yarn defects, yarn defects which follow each other rapidly, and the spinning stations causing these defects.

Since it is very expensive to assign a thread testing device to each individual spinning station for detecting moiré or for detecting yarn defects which occur in batches, and also because space is usually not available for this purpose, it has already been proposed in the prior art to install thread testing devices for detecting moiré in a travelling servicing device of the hereinafore-mentioned type, as shown in German Published, Non-Prosecuted Application DE-OS 25 25 560. It has also already been proposed to construct a thread testing device for detecting moiré as a separate device which can travel along the machine.

These proposals, however, have not found acceptance. The following reasons were decisive in impeding implementation of these proposals:

A modern open end spinning machine has more than 90 spinning stations on each machine side, i.e. a total of more than 180 spinning stations in all. Such an open end spinning machine is more than 26 meters long. A travelling servicing device runs along the open end spinning machine in the oscillating-traffic mode and requires approximately one minute of travelling time for each machine side. It can therefore travel from a disturbed spinning station to another one in a very short time. If the servicing device is then combined with a thread testing device for detecting moire, it can no longer travel to a disturbed spinning station fast enough if the thread testing device happens to be active. The thread test itself takes about one to two minutes while the working time of a servicing device without repetition is at most 20 seconds. Even if the servicing device is given circuit priority, a running thread test operation is not broken off so that delays in the servicing work can always be expected. It is furthermore necessary to install a direct reporting line from all spinning stations to the servicing device because otherwise the thread tester would always have the highest priority in an undesirable manner. It can be seen from these difficulties, which are not even listed exhaustively, that combining a servicing device with a thread testing device for detecting moiré must interfere with the one activity as well as the other.

Two devices which can be moved separately can likewise not be installed in parallel without difficulty because of the different mode of operation. It must always be possible for the servicing device to quickly get to a disturbed spinning station because a shut-down spinning station means a direct loss in output. The thread testing device for detecting moiré, on the other hand, must perform the thread test entirely systematically and in sequence for all spinning stations. Jumping from one spinning station to another or from one machine side to another, skipping a completely undetermined number of spinning stations, is not possible. The thread testing device must not simply be pushed to one side by the high-priority servicing device. Giving way on the running track is also not possible because both devices require considerable space and may have to be active at the same positions of the individual spinning units.

It is accordingly an object of the invention to provide a double-sided open end spinning machine, which overcomes the hereinafore-mentioned disadvantages of the heretofore-known devices of this general type, and to allow the performance of a systematically operating thread test without great expense and without interfering with the automatic servicing operation, particularly for detecting moiré and/or for detecting yarn defects which occur in bunches.

With the foregoing and other objects in view there is provided, in accordance with the invention, a double-sided open end spinning machine, comprising at least one closed travel track, a servicing device for travelling along the machine and a thread testing device for travelling along the machine, at least the servicing device being disposed on the at least one closed travel track, the servicing device including a travel direction reversing device and a travel obstacle indicator for each travel direction, the travel obstacle indicator being connected to the travel direction reversing device for reversing travel direction of the servicing device.

Advantageously, provision is made for the thread testing device to perform the thread tests in an undisturbed manner for as long as necessary and systematically advancing from one spinning station to another or from one spinning station group to another spinning station group. In the meantime, the servicing device is capable of reversing its direction of travel after it approaches the thread testing device, and of travelling around the open end spinning machine to the other side of the thread testing device. Depending on the requirement, it can be active at all spinning stations except for those spinning stations at which the thread testing device happens to operate.

This does not cause any appreciable loss in efficiency because, after all, the thread testing device also operates so fast so that those spinning stations at which the thread testing device was still active in the preceding travel cycle are included in the next travel cycle of the servicing device.

In accordance with another feature of the invention, the servicing device and thread testing device are movably disposed on the same track. It is therefore not necessary to provide a double track system.

As soon as the thread testing device has passed through an entire testing cycle, i.e., all spinning stations of the open end spinning machine have been tested, a new testing cycle need not necessarily start over again. The thread testing device can also be moved subsequently to a ready position at the machine end. This is a position in which a thread testing device cannot block any spinning station. Quite frequently, several open end spinning machines are installed next to each other. In order to allow one and the same thread testing device to become active at two or more open end spinning machines in this case, there is provided, in accordance with a further feature of the invention, another adjacent open end spinning machine having a closed travel track, and at least one controlled transfer switch connecting the tracks to each other. If such a switch is provided, the thread testing device can also sequentially become active at other open end spinning machines. This results in a further cost reduction in yarn production output.

In the simplest case, in accordance with an added feature of the invention, the spinning machine has first and second sides and first and second head frames, and the closed travel track comprises a first straight track section extended along the first side of the spinning machine, a first curved track section adjoining the first straight track section and extended around the first head frame of the spinning machine, a second straight track section adjacent the first curved track section and extended along the second side of the spinning machine, and a second curved track section adjacent the second straight section and extended around the second head frame of the spinning machine. All of these track sections are joined together to form a closed circular track. If switches are provided between adjacent open end spinning machines, a somewhat modified track arrangement may result.

If an open end spinning machine is to be constructed from scratch, suitable closed travel tracks can be provided immediately. It is advantageous to provide a travel rail at the bottom and a support rail at the top. In this manner the movable devices can be guided securely.

However, there are also open end spinning machines in which a servicing device running along the side of the machine is already provided and includes no closed travel track as yet. In such spinning machines, the track begins with a straight track section which is mounted along one side of the spinning machine. Adjacent to this is a bent track section which is brought around a head frame of the spinning machine. The curved track section is finally followed on the other machine side by a straight track section which ends at a second head frame. Thus, a narrow head frame is provided which makes bypassing possible and on the opposite side, a somewhat wider head frame is provided which cannot simply be bypassed.

To also give the advantages of the invention to such machines, in accordance with an additional feature of the invention, the first straight track section starts at the second head frame of the open end spinning machine, the second straight track section ends at the second head frame, and including controlled switches connecting the second curved track section extended around the second head frame to the first and second straight track sections.

It is conceivable to switch such switches manually. This, however, is quite impractical in spinning machines which otherwise operate automatically. Therefore, each switch is advantageously connected to a switch changing device which can be operated by the servicing device or the thread testing device in the priority travelling direction. The point switching device can always be actuated, for instance, if the servicing device approaches a switch in the direction toward the wider head frame. Therefore, in accordance with again another feature of the invention, there are provided point switching devices each being connected to one of the controlled switches and being actuatable in a given travel direction by at least one of the servicing and thread testing devices.

In accordance with again a further feature of the invention, the two point switching devices are connected in parallel and are each connected to both of the controlled switches for operating the controlled switches.

It will be assumed, for instance, that as the initial condition both switches are closed. If the servicing device now approaches in the direction toward the wider head frame of a switch, it switches both switches off by means of the point switching device and continues to travel to the wider head frame, where the direction is reversed. Then, the servicing device returns until it touches the thread testing device, whereupon the direction of travel is reversed again. If the point switching device is now operated a second time, both switches are switched on and the servicing device is conducted past the wider head frame to the other machine side. After negotiating the two switches, the servicing device continues to travel until it touches the thread testing device from the other side. In passing the second point switching device, no reversal takes place because it is not in the preferred or given direction. After the servicing device has reversed its direction of travel again at the thread testing device, it switches off both switches when passing the second point switching device and again travels to the wider head frame. There, its direction of travel is reversed again, the servicing device once more approaches the thread testing device, reverses its direction of travel there again and, on the return trip, again operates the point switching device which thereupon switches on both switches. Now the servicing device is conducted again around the wider head end of the open end spinning machine to the other machine side. The back-and-forth travel of the servicing device then proceeds continuously according to the cycle described above. It is seen that the servicing device always travels first in a straight run up to the wider head frame, back again to the thread testing device and thereupon, on the return trip, is conducted around the wider head end, travels to the other machine side again to the thread testing device, continues to run on the return trip to the wider head end, back again to the thread testing device and only then is conducted around the wider head end again. Nevertheless, the servicing device travels past all spinning stations of the open end spinning machine which happen not to be covered up by the thread testing device. It can become active at any of these spinning stations if required and if requested.

In accordance with again an added feature of the invention, the thread testing device is not included in the circular travel but travels along a back and forth path from the second head frame along one machine side, around the first head frame and along the other machine side to the second head frame and back again.

Important reasons make it appear advantageous to release the thread testing device from travelling around the wider head frame. The thread testing device operates much more slowly than the servicing device and therefore stays shut down for a relatively long period at a given spinning station or spinning station group. If both movable devices were making the trips described by the example of the servicing device, only one of the two devices would be permitted to switch the switches. In this case it could turn out by chance that for extended periods of time the spinning stations located between the switches and the wider head frame could no longer be approached by one or the other device because the respective other device could continually switch the switches in an unfavorable manner. Such undesired operation should be avoided to the extent possible.

If the choice has already been made in favor of back-and-forth travel of the thread testing device, it is advantageous if, in accordance with again an additional feature of the invention, there are provided mechanical means for enforcing the travel of the tread testing device along its back-and-forth path.

In accordance with a concomitant feature of the invention, the servicing device and thread testing device have rollers and/or support rollers with flanges formed thereon, the flanges of the rollers of the servicing device being higher than the flanges of the rollers of the thread testing device, the controlled switches have points having recesses formed in the ends thereof each being wider than the flanges but not as deep as the height of the flanges of the rollers and/or support rollers of the servicing device, and the straight track sections each have a slot formed therein being in alignment with the contact-making points of the controlled switches.

Other features which are considered as characteristic for the invention are set forth in the appended claims.

Although the invention is illustrated and described herein as embodied in a double-sided open end spinning machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
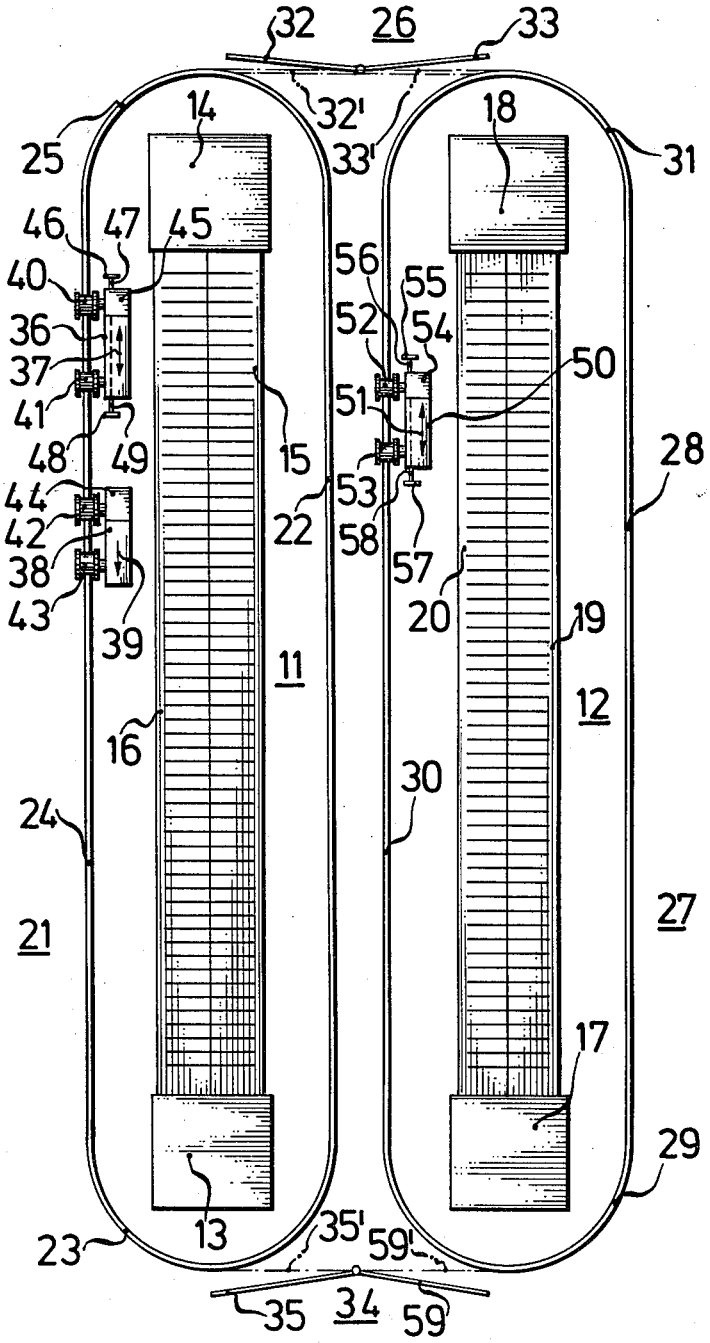
FIG. 1 is a diagrammatic top-plan view of a first embodiment example according to the invention.

Referring now to the figures of the drawing and first particularly to FIG. 1 thereof, there is seen a first open end spinning machine 11 and a second open end spinning machine 12. The first open end spinning machine 11 has a first head frame 13, a second head frame 14, a machine side 15 and a machine side 16. The machine sides are equipped with a multiplicity of like spinning stations, the boundaries of which are indicated by solid lines. The second open end spinning machine 12 has a first head frame 17, a second head frame 18, a first machine side 19 and a second machine side 20. In the case of the second open end spinning machine 12, each machine side also includes identical spinning stations, the boundaries of which are indicated by solid lines.

The open end spinning machine 11 has a closed travel track 21 including a straight track section 22 disposed along the first machine side 15; a curved track section 23 which is adjacent to the former and is brought around the first head frame 13; a further straight track section 24 which is brought alongside the second machine side 16; and a second curved track section 25 which is brought around the second head frame 14.

The second open end spinning machine 12 has a closed travel track 27 including a straight track section 28 which is brought alongside the first machine side 19; a curved track section 29 adjoining the former which is brought around the first head frame 17; a further track section 30 brought alongside the other machine side 20; and a second curved track section 31 which is brought around the second head frame 18.

The curved track section 25 of the open end spinning machine 11 can be connected to the curved track section 31 of the open end machine 12 by a transfer switch 26, the swivel points 32, 33 of which can be brought into the position 32' and 33', respectively, whereby the connection is made. Similarly, the curved track sections 23 and 29 can be connected to each other by a transfer switch 34 by letting their points 35, 59 make contact with the rails of the track sections.

A servicing device 36 is disposed on the closed travel track 21 of the open end spinning machine 11, in such a way that it can be moved in both travel directions, as indicated by a double arrow 37. A thread testing device 38 is disposed on the same closed travel track 21, in such a way as to be movable in only one travel direction as indicated by a single arrow 39.

The servicing device 36 has rollers 40, 41 provided with flanges, and the thread testing device 38 has rollers 42, 43 which are likewise equipped with flanges. The roller 42 of the thread testing device 38 is connected to a propulsion drive 44. The roller 40 of the servicing device 36 is likewise driven and is in connection with a travel direction reversal device 45.

For each travel direction, the servicing device 36 has a travel obstacle indicator which has a functional connection with the travel direction reversing device 45. Thus, a travel obstacle indicator 46 is associated with the functional connection 47, and a travel obstacle indicator 48 is associated with the functional connection 49. Every time a travel obstacle indicator encounters an obstacle, the travel direction reversing device 45 reverses the direction of rotation of the roller 40 and thereby reverses the direction of travel of the servicing device 36.

A servicing device 50 is similarly disposed on the closed travel track 27 of the open end spinning machine 12. This servicing device can also be moved on the circular travel track 27 in both travel directions, as designated by a double arrow 51. The servicing device 50 has two rollers 52, 53 provided with flanges. The roller 52 is driven and is in connection with a travel direction reversing device 54. For each direction of travel, the servicing device 50 also has a travel obstacle indicator. A travel obstacle indicator 55 is connected by a functional connection 56, and a travel obstacle indicator 57 is connected by a functional connection 58, to the travel direction reversing device 54.

If the position of the switches 26, 34 is as indicated in FIG. 1, then the circular travel track 27 of the open end spinning machine 12 has no connection whatsoever with the circular travel track 21 of the open end spinning machine 11. Accordingly, the servicing device 50 will circle the open end spinning machine 12 in the travel direction which happens to be set, since no travel obstacle is present which could reverse the direction of travel. In this circular travel, the desired service procedures are taken care of, upon request.

The servicing device 36 can travel on the closed travel track 23 in a given direction of travel only up to the thread testing device 38. Then, the direction of travel is always reversed. Accordingly, the servicing device 36 travels along the open end spinning machine continuously in a back-and-forth mode. The thread testing device 38 has only one direction of travel. If it has finished its testing task on the machine side 16, it travels past the head frame 13 to the machine side 15. If it has also finished its testing task there, it travels around the head frame 14 back to the machine side 16.

The thread testing device 38 need not circle around the open end spinning machine 11 continuously. This is because as soon as the two points 35, 59 of the transfer switch 34 are placed briefly against the curved track sections 23 and 29, the thread testing device 38 is forced to travel to the open end spinning machine 12 and to dispose of its thread testing task on the closed travel track 27. If the thread testing device 38 is to subsequently return to the open end spinning machine 11, the two points 32, 33 of the transfer switch 36 are placed against the curved track sections 25, 31 for a short time. In a simplified embodiment, it is sufficient to only construct the point 33 of the transfer switch 26 so as to be movable, and to construct the point 32 so as to be locked in the position 32'. In a simplified embodiment, it is likewise sufficient to only construct the point 35 of the transfer switch 34 so as to be movable, and to construct the point 59 so as to be rigid in the position 59'. The servicing devices 36, 50 would then have to be prevented from entering the switches 26, 34, respectively, which is reliably prevented in the two-point switch construction.

Figure 2:
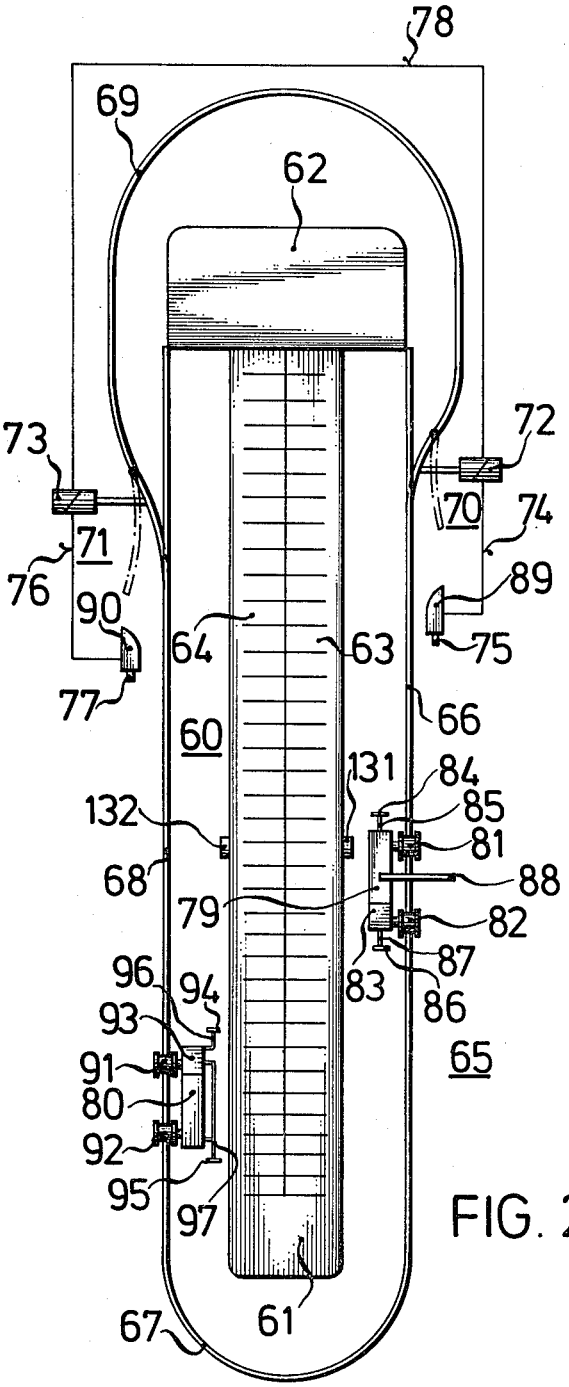
FIG. 2 is a view similar to FIG. 1 of a second embodiment of the invention.

In the second embodiment example of the invention there is provided, according to FIG. 2, an open end spinning machine 60 with a first head frame 61, a second head frame 62, a first machine side 63 located therebetween, and a second machine side 64. A multiplicity of individual spinning stations are disposed on each machine side, the boundaries thereof being indicated by solid lines. The second head frame 62 is substantially wider than the first head frame 61 because it contains drive units and a bobbin tube filling station which, however, is not discussed in detail herein. It is a fact, however, that the head frame 62 cannot be circumvented without problems. Accordingly, the closed travel track designated in this embodiment as a whole with reference numeral 65, is constructed somewhat differently from the first embodiment example. The first straight track section 66 in this case starts at the second head frame 62. The track section 66 is followed by a curved track section 67 which is brought around the head frame 61. Again following the section 67 is a straight track section 68 which ends at the second head frame 62. A second curved track section 69 which is brought around the second head frame 62, is connected by means of controlled switches 70, 71 to the two straight track section 66 and 68, respectively. The switch 70 has an electric positioning motor 72 and the switch 71 an electric positioning motor 73.

Through an electrical functional connection 74, the positioning motor 72 of the switch 70 is connected to a point switching device 75. The positioning motor of the switch 71 is connected to a point switching device 77 by an electrical functional connection 76. In addition, the two positioning motors 72, 73 are connected together by an electrical functional connection 78.

Disposed on the closed travel track 65 and movable in both travel directions, are a servicing device 79 and a thread testing device 80. The servicing device 79 has two rollers 81, 82 equipped with flanges. The roller 82 is driven and has a connection to a travel direction reversal device 83. In addition, the servicing device 79 has a travel obstacle indicator for each direction of travel, each having a functional connection to the travel direction reversing device 83. Thus, the travel obstacle indicator 84 is connected by the functional connection 85, and the travel obstacle indicator 86 is connected by the functional connection 87, to the travel direction reversing device 83. The servicing device 79 also has a resiliently suspended switching vane 88 which serves for actuating the reversing switches 75 and 77. These two point switching devices 75, 77 can only be actuated by the switching vane 88 if the servicing device 79 moves either on the straight track section 66 or on the straight track section 68 in the direction toward the second head frame 62. On the return trip, the point switching devices cannot be actuated because their switching vane repellers 89 and 90, respectively, prevent actuation.

The thread testing device 80 is also equipped with rollers 91, 92. The roller 91 can be driven and is connected to a travel direction reversing device 93. The thread testing device 80 also carries travel obstacle indicators 94, 95 at both ends. These two travel obstacle indicators 94, 95 are constructed in such a way that they cannot come into contact with parts of the servicing device 79, but only with parts of the second head frame 62. The travel obstacle indicator 94 is connected by a functional connection 96, and the travel obstacle indicator 95 is connected by a functional connection 97, to the travel direction reversing device 93.

Figure 3:
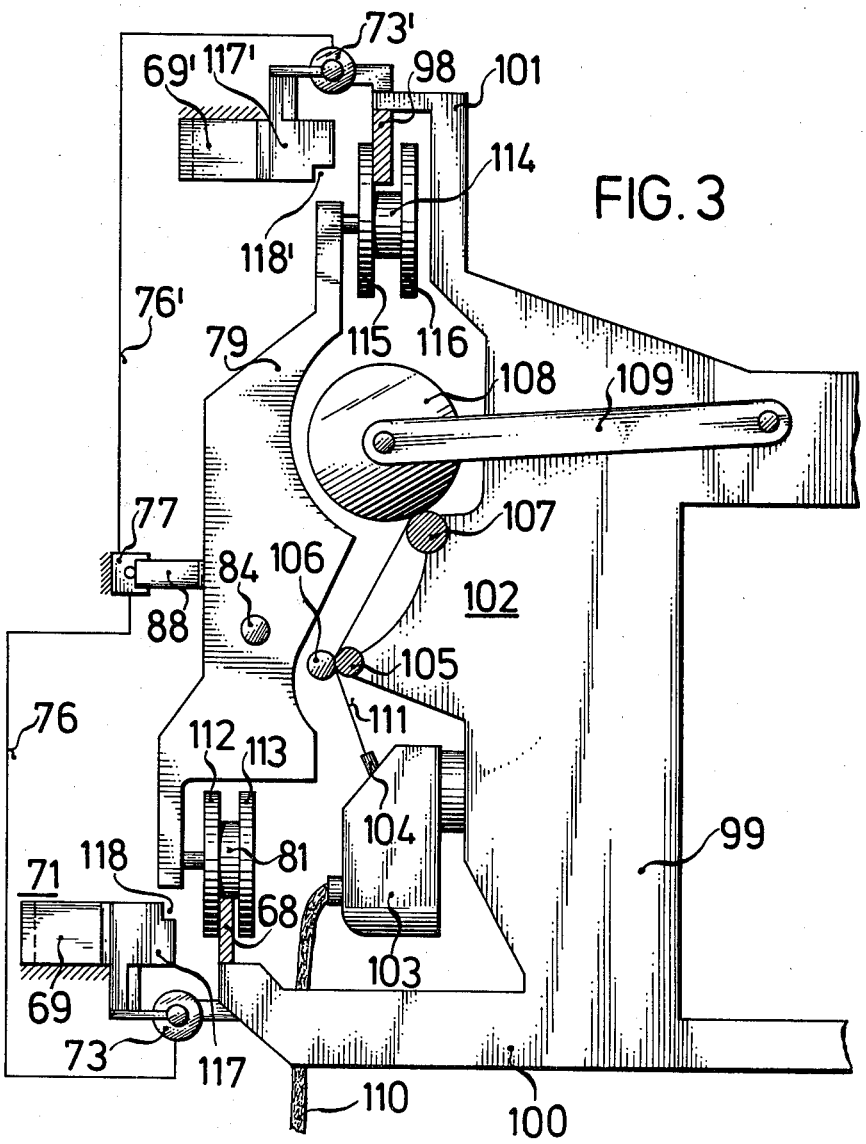
FIGS. 3 and 4 are similar side-elevational views of the invention.
Figure 4:
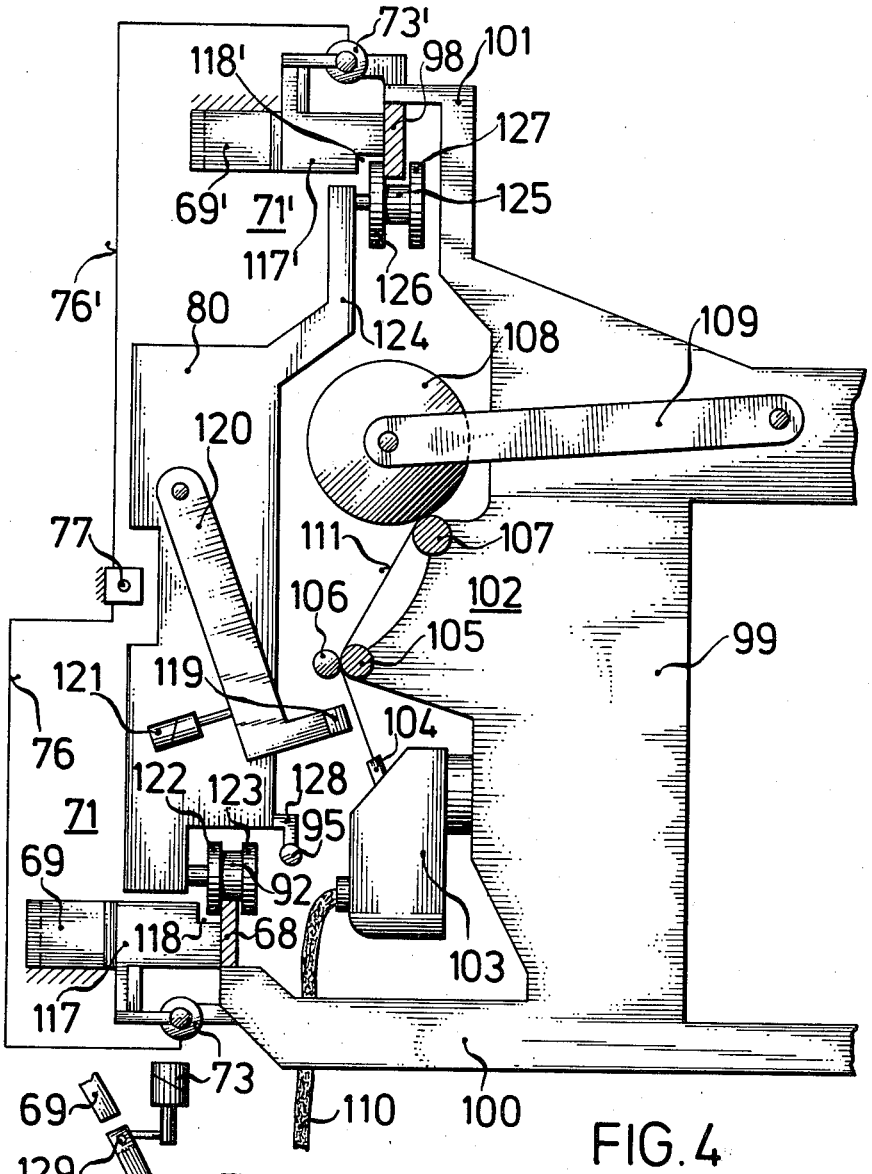

While FIG. 2 shows only one closed travel track 65, a further closed travel track 98 which is visible in cross section in FIGS. 3 and 4, is to be disposed above the movable devices 79 and 80. The details of the track arrangements and the details of the switch arrangement and the switching circuit are identical with those of the closed travel track 65. The two point switching devices 75 and 77 have functional connections not only to the switches of the closed travel track 65 but also to the switches of the closed travel track 98, as is shown in FIG. 3 by the example of the point switching device 77.

FIG. 3 shows the machine frame 99 of the machine side 64 of the open end spinning machine 70. An arm 100 carries the straight track section 68 of the closed travel track 65, and an arm 101 carries the closed travel track 98 which in this case only serves as a support track. At the machine frame 99, there is furthermore diagrammatically shown an individual spinning station, designated overall with reference symbol 102, in a side view. Part of the spinning station 102 is a spinbox 103 with a thread withdrawal tube 104, a pair of withdrawal rolls 105, 106, a rotating winding cylinder 107 and a take-up bobbin 108 which rolls thereon and is held by a swivel arm 109. A sliver strand 110 is introduced into the spinbox 103. The finished thread 111 is drawn from the spinbox and wound on the take-up bobbin 108.

Only the non-driven roller 81 of the two rollers of the servicing device 79 is visible in FIG. 3. The roller 81 has a relatively large diameter and has high flanges 112, 113. The support roll 114 also has a relatively large diameter and has flanges 115, 116 of great height. FIG. 3 shows that the point 117 of the switch 71 is open. At the end of the point 117, a recess 118 is shown. This recess 118 is wider than the width of the flange 112 but not as deep as the flange height. To the left of the switch 71, part of the curved track section 69 is also seen.

Vertically above the switch 71 is a switch 71' for the support rail 98 and its curved track section 69', in a mirror-symmetrical arrangement. The positioning motor 73' of the switch 71', which is fastened to the arm 101, is connected through an electrical functional connection 76' to the point switching device 77 and therefore is also connected to all other switches.

The servicing device 79 travels in the direction toward the second head frame 62. The switching vane 88 of the servicing device 79 which is resiliently constructed and is therefore capable of giving way, has already actuated the point switching device 77, so that all of the switches have just been opened. Upon the next actuation of one of the two point switching devices, all of these switches are closed again. First, however, the servicing device 79 is passed along the straight track section 68 until it is disposed in front of the head frame 62 where the direction of travel is the reverse. One of the travel obstacle indicators 84 required for this purpose is shown in FIG. 3.

The point 117' of the switch 71' also has a recess 118' which is wider than the flange 115 but is not as deep as the height of the flange 115. Therefore, if both switches were closed, the rollers and support rollers, respectively, would have to be deflected in the direction toward the curved track sections 69 and 69', respectively.

FIG. 4 shows the open end spinning machine 60 in the same view as FIG. 3. All stationary parts visible in FIG. 4 are therefore the same as those shown in FIG. 3 and have already been explained hereinafore. Instead of the servicing device 79, the thread testing device 80 is now on the straight track section 68. The thread testing device 80 has a thread testing head 119, which is disposed on a pivotable level 120. The level 120 can be swung out as shown in the figure, by means of an electric positioning motor 121. The thread testing head 119 is now in the testing position, and the thread 111 of the spinning station 102 is just being tested. Before travelling on, the thread testing head 119 is retracted slightly so that it is better protected during the travel.

The non-driven roller 92 of the two rollers is shown in FIG. 4. The rollers of the thread testing device have considerably smaller diameters than the rollers of the servicing device. The height of the two flanges 122, 123 is also much smaller than the height of the flanges of the servicing device 79. It can clearly be seen from FIG. 4 that the thread testing device 80 cannot be deflected by the closed switch 71 because of its small flanges.

The support roller 125 which is supported in an arm 124, likewise has a much smaller diameter than the support roller 114 of the servicing device 79. The height of the flanges 126, 127 is less than that of the flanges 115, 116 of the roller 114, and more specifically it is so small that the flanges cannot be deflected during the further travel by the closed switch 71'. In FIG. 4, one of the two travel obstacle indicators is also visible, namely, the travel obstacle indicator 95 which is fastened to an arm 128 in such a manner that in no case can it touch parts of the servicing device 79.

Figure 5:
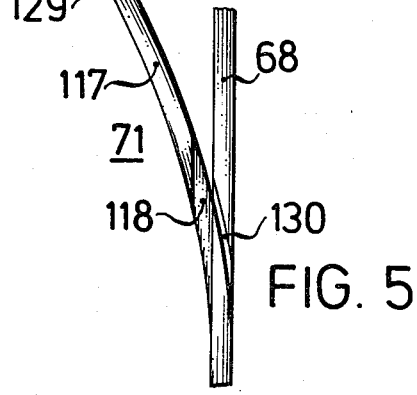
FIG. 5 is a detailed view of a switch of the device.

A simplified view as seen from the top onto the closed switch 71 is shown in FIG. 5. The point 117 which is pivoted about the pivot 129 by the positioning motor 73, is placed against the straight track section 68, coming to a slender point. The track section 68 has a slot 130 formed therein which is aligned with the contacting point 117 of the switch 71. The width of the slot 130 is greater than the width of the flanges but only slightly deeper than the height of the flanges of the servicing device 79. Since the slot is disposed at an angle, it can be passed-by unhindered in straight travel of the movable devices. The recess 118 of the point 117, on the other hand, can only be passed-by in straight travel by the less high flanges of the thread testing device 80. The flanges of the servicing device 79, on the other hand, are deflected in the direction toward the bent track section 69 if the switch is positioned accordingly.

The invention is not limited to the embodiments examples shown and described. Other embodiments are also possible, within the scope of the claims. Through suitable interlocking arrangements, it can be assured, for instance, that the servicing device will not be impeded in the track section between a switch and the head frame 62 in giving way toward the curved track section 69. To this end, a definite waiting position can be provided for the thread testing device at a sufficient distance from the point switching devices, which the thread testing device only leaves when the servicing device has again left the above-mentioned track section. So much time passes up to the instant of the return of the servicing device, that the thread testing device is then already located either at the switch or in the track section between the switch and the head frame 62. In the first case the travel obstacle indicator 89 then comes into contact with the laterally disposed parts of the housing of the thread testing device, whereupon the servicing device is caused to reverse itself. In the second case, the servicing device starts unimpeded on its circular travel.

On the other hand it is also possible to provide indicator blocking switches 131, 132 which, when the thread testing device approaches, prevent any call for the servicing device into the track section between the indicator blocking switches and the head frame 62. If it is located in the above-mentioned track section, the servicing device is thereby forced to give way without delay into the other machine side. Upon its return, so much time has then likewise elapsed that it can no longer be located between the head frame 62 and the thread testing device 80.

The foregoing is a description corresponding to German application No. P 31 11 627.2, dated Mar. 25, 1981, the International priority of which is being claimed for the instant application, and which is hereby made part of this application. Any discrepancies between the foregoing specification and the aforementioned corresponding German application are to be resolved in favor of the latter.

I claim:

1. Double-sided open end spinning machine, comprising at least one closed travel track, a servicing device for traveling along the machine and a thread testing device for traveling along the machine, at least said servicing device being disposed on said at least one closed travel track, said servicing device including a travel direction reversing device and a travel obstacle indicator for each travel direction, said travel obstacle indicator being connected to said travel direction reversing device for reversing travel direction of said servicing device.

2. Open end spinning machine according to claim 1, wherein said servicing device and thread testing device are movably disposed on the same track.

3. Open end spinning machine according to claim 1, including another adjacent open end spinning machine having a closed travel track, and at least one controlled transfer switch connecting said tracks to each other.

4. Open end spinning machine according to claim 1, wherein the spinning machine has first and second sides and first and second head frames, and said closed travel track comprises a first straight track section extended along the first side of the spinning machine, a first curved track section adjoining said first straight track section and extended around the first head frame of the spinning machine, a second straight track section adjacent said first curved track section and extended along the second side of the spinning machine, and a second curved track section adjacent said second straight section and extended around the second head frame of the spinning machine.

5. Open end spinning machine according to claim 4, wherein said first straight track section starts at the second head frame of the open end spinning machine, the second straight track section ends at the second head frame, and including controlled switches connecting said second curved track section extended around the second head frame to said first and second straight track sections.

6. Open end spinning machine according to claim 5, including point switching devices each being connected to one of said controlled switches and being actuatable in a given travel direction by at least one of said servicing and thread testing devices.

7. Open end spinning machine according to claim 6, wherein said point switching devices are connected in parallel and are each connected to each of said controlled switches for operating said controlled switches.

8. Open end spinning machine according to claim 5, 6 or 7, wherein said thread testing device travels along a back and forth path from the second head frame along one machine side, around the first head frame and along the other machine side to the second head frame and back again.

9. Open end spinning machine according to claim 8, including mechanical means for enforcing the travel of said thread testing device along its back and forth path.

10. Open end spinning machine according to claim 8, wherein said servicing device and thread testing device have rollers with flanges formed thereon, said flanges of said rollers of said servicing device being higher than said flanges of said rollers of said thread testing device, said controlled switches have points having recesses formed in the ends thereof each being wider than said flanges but not as deep as the height of said flanges of said rollers of said servicing device, and said straight track sections each have a slot formed therein being in alignment with said points of said controlled switches.

* * * * *